US006464747B2

(12) United States Patent
Enya et al.

(10) Patent No.: US 6,464,747 B2
(45) Date of Patent: Oct. 15, 2002

(54) SINTERED CERMET MATERIAL FOR CUTTING TOOLS AND METHOD FOR PRODUCING THE SAME

(75) Inventors: Yasuhiro Enya, Kariya (JP); Kenji Gotoh, Kawachi-gun (JP); Satoru Hosomi, Oyama (JP)

(73) Assignees: Aisin Seiki Kabushiki Kaisha, Kariya (JP); Tomei Diamond Co., Ltd., Oyama (JP)

( * ) Notice: Subject to any disclaimer, the term of this patent is extended or adjusted under 35 U.S.C. 154(b) by 0 days.

(21) Appl. No.: 09/991,647

(22) Filed: Nov. 26, 2001

(65) Prior Publication Data

US 2002/0094296 A1 Jul. 18, 2002

(30) Foreign Application Priority Data

Nov. 24, 2000 (JP) ..... 2000-358154

(51) Int. Cl.[7] ..... C22C 29/02; B22F 3/14

(52) U.S. Cl. ..... 75/235; 75/236; 75/238; 75/244; 419/48

(58) Field of Search ..... 75/235, 236, 238, 75/244; 419/48

(56) References Cited

U.S. PATENT DOCUMENTS 4,587,174 A * 5/1986 Yoshimura et al. ..... 428/552
4,828,584 A * 5/1989 Cutler ..... 51/307
5,149,361 A * 9/1992 Iyori et al. ..... 75/233

FOREIGN PATENT DOCUMENTS

JP 62-278265 12/1987
JP 62-280362 12/1987

* cited by examiner

*Primary Examiner*—Ngoclan Mai
(74) *Attorney, Agent, or Firm*—Oblon, Spivak, McClelland, Maier & Neustadt, P.C.

(57) ABSTRACT

Sintered cermet materials far tools such as cutting tools, which are excellent in heat resistance, wear resistance and fracture resistance, are inexpensive, and have long life time, and a method for producing such sintered cermet materials. The sintered cermet materials for tools are composed of sintered bodies which are obtained by preparing a mixed powder containing powders of TiCN, $Si_3N_4$, $Al_2O_3$, CrxN (x=1–2.7 and ZrN, at least one powder of W and WC, and at least one kind of metal powder selected from the group consisting of Co, Ni, Ta and Mo, and sintering the mixed powder .

25 Claims, 2 Drawing Sheets

SINTERED CERMET MATERIAL FOR CUTTING TOOLS AND METHOD FOR PRODUCING THE SAME

BACKGROUND OF THE INVENTION

1. Field of the Invention

The present invention elates to a sintered cermet material which can be effectively use in tools for machining special work pieces, end a method for producing such cermet material. The sintered cermet material of the present invention is in particular suited for machining high class cast iron such as niresist cast iron and austempered spheroidal graphite cast iron, as well a normal cast irons including spheroidal graphite cast iron and flaky graphite cast iron. The products are especially adapted for an efficient machining at a high feeding rate.

2. Technical Background

The technical background will be explained with reference to cutting tools for machining high class cast iron such as niresist cast iron and austempered spheroidal graphite cast iron. Niresist (Ni-Resist) cast iron is a nickel-chromium-copper austenitic cast iron, in which graphite is distributed in an austenite matrix. Niresist cast iron is excellent in resistance against wear, heat and corrosion, in relation to normal cast irons, and accordingly is widely used as a material for various machine parts which are demanded both hot strength and wear resistance as employed in corrosive circumstances. In particular, recent remarkable improvements in automotive has made performance of motor vehicles have made niresist cast iron principal material for the primary parts of motor vehicles. On the other hand, in an austempered spheroidal graphite cast iron, which is obtained by heat-treating spheroidal graphite cast iron, graphite particles exist in bainite and austenite phases. For this type of cast iron reference is made to JIS G 5503 FCAD 1000-5. Austempered spheroidal graphite, with such high tensile strength and excellent wear resistance over common cast irons, has become a promising material for mechanical parts to be used in aggressive circumstances. It surely is going to be a good material for the construction of motor vehicles, which are now under pressure of reduction in body size and weight.

In order to shape high class cast iron such as these niresist cast iron and austempered spheroidal graphite cast iron into final configuration and dimensions of the basic important parts, normally, the high class cast iron has been frequently required to be subjected to s cutting work after cast. Cutting tools for cutting high class cast iron such as these niresist cast iron and austempered spheroidal graphite cast iron must have the performance that such high class cast iron can be cut rapidly with a required cutting accuracy without waste. If tip ends of cutting tools are worn out or fractured upon chipping or like operations, there occur folding and burr in cut surfaces of high class cast iron such as these niresist cast iron and austempered spheroidal graphite cast iron, and consequently required dimensional accuracy and surface roughness cannot be obtained, resulting in products that cannot be shipped.

For these reasons, when the tip ends of the cutting tools are worn out or fractured, the cutting tools must be immediately replaced. The replacement of cutting tools decreases the productivity. Therefore, the number of replacements must be reduced to its minimum For this reason, the development of cutting tools that have long tool life and are inexpensive has been earnestly demanded. TiCN sintered cermet materials disclosed is publications of Japanese unexamined patent applications Nos. Sho 62-280362 and Sho 62-278265, for example, have been proposed as materials for cutting tools capable of overcoming these problems.

High class cast iron such as these niresist cast iron and austempered spheroidal graphite cast iron (hereinafter referred to as ADI) exhibits high hardness, and is excellent in wear resistance, as compared with normal spheroidal graphite cast iron, and in ADI, the austenite structure is transformed to martensite due to stress generated upon cutting the work, and consequently the hardness of the structure itself increases remarkably during the cutting work in addition such high class tact iron generates heat vigorously during the cutting work. as compared with the case of normal spheroidal graphite cast iron. Furthermore, where the high class cast iron castings have a roughened as-cast surface, which needs to be cut first. Upon cutting these coarse casting surfaces, interrupted cuts which cause vibration may occur. Accordingly, cutting tools have been required to exhibit toughness endurable against these interrupted cuts.

As described above, the cutting tools for machining high class cast iron are required to have a wear resistance adequate for the hard high class cast iron, heat resistance causing no thermal degradation (decrease in hardness) due to heat upon cutting, and toughness (fracture resistance) enduring the interrupted cuts which occur upon cutting casting surfaces. The TiC sintered cermet materials disclosed in the above-described publications, however, are particularly low in heat resistance so that the hardness thereof decreases due to beat upon cutting, and consequently the wear resistance is decreased. This results in that the cutting tools must be replaced frequently.

In order to improve only the wear resistance (hardness), cutting tools, each containing cBN and diamond, may be used. These cutting tools, however, are low in toughness, and consequently, may be fractured during cutting works.

As described above, conventionally, there have been used no cutting tools exhibiting the wear resistance, heat resistance and fracture resistance, which are all inquired to cut high class cast iron such as niresist cast iron and austempered spheroidal graphic cast iron, and accordingly the extension of the tool life, which has been desired as cutting tools, has not been able to be effected.

SUMMARY OF THE INVENTION

It is one object of the present invention to provide sintered cermet materials capable of composing inexpensive tools such as cutting tools, which exhibit excellent heat resistance, wear resistance and fracture resistance, and have long life time, and a method for producing such sintered cermet materials.

It is another object of the present invention to provide sintered cermet materials capable of composing inexpensive cutting tools, each having long tool lift, which can cut metal work pieces composed of not only normal cast iron such as spheroidal graphite cast iron and flake graphite cast iron but also high class cast iron such as niresist cast iron and austempered spheroidal graphite cast iron, inclusive of casting surfaces thereof under severe conditions such as a high speed cutting, heavy cutting, and interrupted cutting, and a method for producing such sintered cermet materials, especially where the present invention is applied to cutting tools as typical tools.

The present inventors have continued to develop sintered cermet materials for cutting tools and a method for producing such sintered cermet materials over many years. As a result, they have found that by preparing a mixed powder containing powders of TiCN, $Si_3N_4$, $Al_2O_3$, CrxN (x=1–2.7) and ZrN, at least one powder of W and WC, and at least one metal powder selected from the group consisting Co, Ni, Ta and Mo, and by sintering the prepared mixed powder ,the above-described objects can be achieved, and, based on this finding, they have completed the present invention The reason why the above-described objects can be achieved has not been sufficiently clarified, but can be estimated as follows: By preparing a mixed powder containing .powders of TiCN, $Si_3N_4$, $Al_2O_3$, CrxN (x=1–2.7) and ZrN, at least one powder of W and WC, and at least one metal powder selected from the group consisting of Co, Ni, Ta and Mo, and sintering the prepared mixed powder to compose a sintered cermet material, the crystal structure has a structure varied from TiCN, $Si_3N_4$, $Al_2O_3$, CrxN (x=1–2.7) as starting raw materials, and this new phase contributes to the improvement of the quality of the material upon cutting or other operations. Where the sintered cermet material is composed by sintering another mixture material which is similar to the above-described mixture material but does not include CrxN, such new phase does not appear, and sufficient heat resistance, wear resistance, fracture resistance or the like are not always obtained.

The sintered cermet material in accordance with e first aspect of the present invention is characterized in that the sintered cermet material is composed of a sintered body which is obtained by preparing a mixed powder containing powders of TiCN, $Si_3N_4$, $Al_2O_3$, CrxN (x=1–2.7) and ZrN, at least one powder of W and WC, and at least one metal powder selected from the group consisting of Co, Ni, Ta and Mo, and by sintering the prepared mixed powder, The method for producing sintered cermet materials in accordance with a second aspect of the present invention is characterized in that the method includes: the steps of preparing a mixed powder containing powders of TiCN, $Si_3N_4$, $Al_2O_3$, CrxN (x=1–2.7) and ZrN, at least one powder of W and WC, and at least one metal powder selected from the group consisting of Co, Ni, Ta and Mo, and sintering the prepared mixed powder to obtain a sintered body.

The most noticeable point in the present invention is that by sintering using TiCN, $Si_3N_4$, $Al_2O_3$, CrxN (x=1–2.7) and ZrN, the crystal structure has a structure varied from starting raw materials composing the mixed powder is recognized. It is estimated that by virtue of these materials, the heat resistance of tools such as cutting tools is improved, the hardness and the strength in as elevated temperature region is ensured, the wear resistance and the fracture resistance are improved, and the extension of tool life can be effected.

Therefore, where the sintered cermet material of the present invention is applied to the cutting tool as a representative tool, the sintered cermet material for cutting tools which can cut work pieces composed of materials, each being difficult to be cut, such as high class cant iron including niresist cast iron and austempered spheroidal graphite cast, at high speed and intermittently, can be obtained. With the present invention, there can be obtained cutting tools which exhibit excellent wear resistance and toughness tinder conditions such as a high speed cutting, and have long tool life even where an intermittent cutting is performed, as compared with the conventional sintered cermet materials.

In order that the mixed powder enables the achievement of the above-described functions, it is preferable that the mixed powder contains 1 to 20 vol. % of TiCN, 1 to 10 vol. % of $Si_3N_4$, 1 to 20 vol. % of $Al_2O_3$, 5 to 15 vol. % of CrxN (x=1–2.7) and 5 to 15 vol. % of ZrN such that the total of powders of TiCN, $Si_3N_4$, $Al_2O_3$, CrxN and ZrN ranges from 13 to 70 vol. %, and the mixed powder further contains 20to 70 vol. % of at least one of W and WC, and 1 to 20 vol. % of at least one selected from the group consisting of Co, Ni, Ta and Mo. Where such mixed powder is sintered, the resulting sintered cermet materials have a different crystal structure from that of TiCN, $Si_3N_4$, $Al_2O_3$, CrxN (x=1–2.7) and ZrN, and by virtue of strong bonding of these materials, excellent sintered cermet materials having long service life, which can cut work pieces, each being composed of materials difficult to be cut, such as high class cast iron including niresist cast iron and austempered spheroidal graphite cast, at high speed and intermittently, can be obtained.

TiCN, titanium carbonitride, is formed with a continuous solid solution of Ti and TiC, each having a cubic system. The atomic number ratio of N and C may range from (1:9) to (9:1). In order to obtain characteristics of both TiCN and TiC favorably, the range from (2:8) to (8:2) is preferable. Where the amount of TiCN is too small, it is difficult to act as the raw material of the sintered cermet material in accordance with the present invention On the other hand, where the amount of TiCN is excess, the balance with other starting materials such as $Si_3N_4$, $Al_2O_3$, CrxN (x=1–2.7) and ZrN is difficult to be kept, and accordingly, it is difficult to obtain a desired mixed powder . Accordingly, the preferred composition ratio of TiCN ranges from 1 to 20 vol. %, and more preferably ranges from 5 to 20 vol. %. In accordance with demand, 18%, 16% and 14%, for example, can be adopted as the upper limit of the composition ratio of TiCN, and 6%, 8% and 10%,for example, can be adopted as the lower limit thereof.

It is preferable that the particle size of TiCN powder is small. Where the particle size of TiCN powder exceeds 10 $\mu$m, new materials resulting from the above-described composition are not formed sufficiently. Under some sintering conditions, TiCN may excessively remain after sintered. In addition, even if all TiCN reacts and desired materials are formed, it may occur the problem that the formed materials segregate and do not disperse homogeneously. Accordingly, it is preferable that the particle size of TiCN is 5 $\mu$m or less and, more preferably, 2 $\mu$m to 1 $\mu$m or less. In general, super fine particles, each having a particle size of 0.1 $\mu$m or less, are preferable. In this case, it is necessary to consider the removal of gas adsorbed in such fine powders.

It is preferable that the TiCN raw material for use in the present invention is a compound of a solid solution. Otherwise, a compact mixture of TiC and R can be used. For example, by using mechanical alloying method of mixing and pulverizing TiC powder and Ti powder, each being weighed to have a predetermined ratio, and having a particle size of several micron or less, to obtain powders having sizes of submicron a sintered material equal to the solid solution can be obtained.

Examples of the pulverizing device used in this case include general purpose devices such as ball mills, vibration mills, planetary mills. Upon pulverizing, in order to prevent intrusion of components other than the composition materials of the present invention, balls, each being made of cermet which has substantially the same quality as that of the composition of the present invention, are used. Otherwise, balls, each being made of alumina or cemented carbide as one component of the material of the present invention, are suitable.

$Si_3N_4$ has hexagonal system alpha-type and trigonal system $\beta$type in the crystal structure thereof. Basically, any type of the crystal structure is applicable. It is considered that the hexagonal system alpha-type which is easy to dissolve oxygen in a solid state is preferable. Where the amount of $Si_3N_4$, is too small, it is difficult W act $\mu$the raw material of the sintered cermet material in accordance with the present invention. On the other hand, where the amount of $Si_3N_4$ is in excess, the balance with other starting materials such as TiCN $Al_2O_3$, CrxN (x=1–2.7) and ZrN is difficult to be kept, and it is difficult to obtain a desired mixed powder. Accordingly, the preferred composition ratio of $Si_3N_4$ ranges from 1 to 10 vol. % and, mote preferably, from 5 to 10 vol. %. In accordance with demand, 9%, 8% and 7%,for example, can be adopted as the upper limit of the composition ratio of $Si_3N_4$, and 3%, 4% and 6%,for example, can be adopted as the lower limit thereof. It is preferable that the particle size of $Si_3N_4$ powder is small. Where the particle size of $Si_3N_4$ powder exceeds 10 $\mu$m, new materials to be resulted from the above-described composition are not formed sufficiently. Under some sintering conditions, $Si_3N_4$ may excessively remain after sintered In addition, even if all $Si_3N_4$ reacts and desired materials are formed, it may occur the problem that the formed materials segregate and do not disperse homogeneously. Accordingly, although sufficient attention should be paid to pollution caused by impurities, it is preferable that the particle size of $Si_3N_4$ is 5 $\mu$m or less and, more preferably, 2 $\mu$m to 1 $\mu$m or less. In general, super fine particles, each having a particle size of 0.1 $\mu$m or less, are preferable, In this case, it is necessary to consider the removal of gas adsorbed in such fine powders.

There are many types of crystal structures in $Al_2O_3$. Basically, the crystal structure thereof is not limited specifically, but $\gamma$ type of the cubic system spinel type which changes to alpha-type at 1000° C. or more, and $\beta$ type of the trigonal system corundum type which is stable at high temperatures are preferable. Where the amount of $Al_2O_3$ is too small, it is difficult to act as the raw material of the sintered cermet material in accordance with the present invention. On the other hand, where the amount of $Al_2O_3$ is in excess, the balance with other starting materials such as TiCN, $Si_3N_4$, CrxN (x=1–2.7) and ZrN is difficult to be kept, and it is difficult to obtain a desired mixed powder. Accordingly, the preferred composition ratio of $Al_2O_3$ ranges from 1 to 20 vol. % and, more preferably, ranges from 5 to 20 vol. % to ensure favorable properties. In accordance with demand, 19%, 18% and 17%, for example, can be adopted as the upper limit of the composition ratio of $Al_2O_3$ and 6%, 8% and 10%, for example, can be adopted as the lower limit thereof. It is preferable that the particle size of $Al_2O_3$ powder is small. $Al_2O_3$, powder of a high purity, each having the particle size of 1 $\mu$m or less, can be easily obtained, and accordingly such $Al_2O_3$ powder may be used. In this case, problems such as insufficient reaction and segregation which have been encountered with the case of TiCN, $Si_3N_4$ or the like can be restrained. In general, it is preferable that $Al_2O_3$ powder is super fine particles of which the particle size is 0.1 $\mu$m or less. In this case, it is necessary to consider the removal of gas adsorbed in such fine powders.

In CrxN (x=1–2.7) which is chromium nitride, CrN and Cr2N mainly exist. These materials are both non-stoichiometric compounds. Where the composition ratio of CrxN (x=1–2.7) is less than 5%, it is difficult to act as a starting raw material of the sintered cermet material in accordance with the present invention. On the other hand, where the composition ratio of Cr xN is in excess, the balance with TiCN, $Si_3N_4$, $Al_2O_3$, and ZrN as other staring materials is difficult to be kept, and it is difficult to obtain a desired mixed powder . Accordingly, the preferred composition ratio of CrxN (x=1–2.7) ranges from 5 to 15 vol. % and, more preferably, ranges from 8 to 13 vol. %. In accordance with demand, 14%, 13% and 12%, for example, can be adopted as the upper limit of the composition ratio of CrxN and 6%, 7 and 8%, for example, can be adopted as the lower limit thereof. It is preferable that the particle size of CrxN (x=1–2.7) powder is small. When the particle size of CrxN (x=1–2.7) powder exceeds 10 $\mu$m, desired materials are not formed sufficiently. Under some sintering conditions, CrxN (x=1–2.7) may excessively remain after sintered Even if all CrxN (x=1–2.7) reacts and desired materials are farmed, it may occur the problem that the formed materials segregate and do not disperse homogeneously. Accordingly, although sufficient attention should be paid to pollution caused by impurities where the particle size is small, it is preferable that the particle size of CrxN (x=1–2.7) is 5 $\mu$m or less, and more preferably 2 $\mu$m to 1 $\mu$m or less. In general, super fine particles, each having a particle size of 0.1 $\mu$m or less, are preferable. In this case, it is necessary to consider the removal of gas adsorbed in such fine powders.

ZrN which is zirconium nitride exhibits high hardness and high toughness at elevated temperatures, and where ZrN is used as the material of cutting tools, it is favorable for reducing the wetting property with work pieces. Where the amount of ZrN is too small, it is difficult to act as the raw material of the sintered cermet material in accordance with the present invention. On the other hand, where the amount of ZrN is in excess, the balance with other starting materials such as TiCN, $Si_3N_4$, $Al_2O_3$ is difficult to be kept, and it is difficult to obtain a desired mixed powder . Accordingly, the preferred composition ratio of ZrN ranges from 5 to 15 vol. % and, more preferably, from 8 to 13 vol. %. In accordance with demand, 14%, 13% and 11%,for example, can be adopted as the upper limit of the composition ratio of ZrN, and 6%, 7% and 8%,for example, can be adapted es the lower limit thereof. It is preferable that the particle size of ZrN powder is small. Where the particle size of ZrN powder exceeds 10 $\mu$m, desired materials to be resulted from the above composition are not formed sufficiently. Under some sintering conditions, ZrN may remain after sintered Even if all ZrN reacts and desired materials are formed, it may occur the problem that the formed materials segregate and do not disperse homogeneously. Accordingly, although sufficient attention should be paid to pollution caused by impurities where the particle size is small, it is preferable that the particle size of ZrN is 5 $\mu$m or less and, more preferably, 2 $\mu$m to 1 $\mu$m or less. In general, super fine particles, each having a particle size of 0.1 $\mu$m or less, are preferable. In this case, it is necessary to consider the removal of gas adsorbed in such fine powders.

With the present invention, in order to obtain good sintered cermet materials, it is preferable that the mixed powder contains powders of TiCN, $Si_3N_4$, $Al_2O_3$, CrxN and ZrN such that the composition ratio of the total thereof ranges from 13% to 70 vol. %.

Tungsten which is W is added as a metallic component for ensuring the toughness, or added to form tungsten carbide. W is the cubic system, and the alpha phase of the body-centered cubic lattice thereof is stable. Basically, the crystal structure thereof is not limited specifically, but alpha-type which is a stable system is preferable. On the other hand, WC as tungsten carbide includes two kinds of alpha-type (hexagonal system crystal and B type (cubic system crystal). Basically, the crystal structure thereof is not limited specifically. At least one of powders of W and WC is contained in the mixed powder . In this case, the mixed powder may contain only W, only WC, or both W and WC. When the composition ratio of W and WC in the mixed powder is less than 20%, it is difficult to act as the raw material of the sintered cermet material in accordance with the present invention. On the other hand, where the composition ratio of W and WC in the mixed powder exceeds 70%, the balance with other starting materials such as TiCN, $Si_3N_4$, CrxN (x=1–2.7), ZrN, Co, Ni, Ta and Mo is difficult to be kept, and it is difficult to obtain a desired mixed powder. Accordingly it is difficult to obtain a desired sintered material. Therefore, the preferred composition ratio of at least one powder of W and WC in the mixed powder ranges from 20 to 70 vol. % and, more preferably, from 30 to 60 vol. %. In accordance with demand, 65%, 55% and 45%,for example, can be adopted as the upper limit of the composition ratio of at least one powder of W and WC, and 23%, 25% and 30%,for example, can be adopted es the lower limit thereof.

It is preferable that the particle size of at least one powder of W and WC is small. At least one powder of W and WC of a high purity, each having a particle size of 1 $\mu$m or less, can be easily obtained, and accordingly such $Al_2O_3$ powder may be used. In this case, it is preferable for reducing problems such as insufficient reaction and segregation which have been encountered with the case of TiCN, $Si_3N_4$ or the like. In general, it is preferable that at least one powder of W and WC is composed of super fine particles of which the particle size is 0.1 $\mu$m or less. In this case, it is necessary to consider the removal of gas adsorbed in such fine powders.

With respect to Co, Ni, Ta and Mo as metallic components other than W, basically, the crystal structure thereof is not limited specifically. One kind of Co, Ni, Ta and Mo may be contained, or two kinds or more thereof may be contained.

When the composition ratio of the above-described metallic components in the mixed powder is too small, it is difficult to act as the raw materials of the sintered cermet material in accordance with the present invention. On the other hand, where the composition ratio of the above-described metallic components in the mixed powder is in excess, the balance with other starting materials such as TiCN, $Si_3N_4$, CrxN (x=1–2.7), ZrN, W and WC is difficult to be kept and it is difficult to obtain a desired sintered cermet material. Accordingly, the preferred composition ratio of at least one kind of metallic powders of Co, Ni, Ta and Ma ranges from 1 to 20 vol. % and, more preferably, from 5 to 15 vol. %. 18%, 17% and 16%,for example, can be adopted as the upper limit of the composition ratio of at least one powder of Co, Ni, Ta and Mo, and 3%, 4% and 5%, for example, can be adopted as the lower limit thereof. It is preferable that the particle size of at least one powder of Co, Ni, Ta and Mo is small. At least one powder of Co, Ni, Ta and Mo of high purity, each having a particle size of 1 $\mu$m or less, can be easily obtained, and accordingly such fine powder may be used In this case, it is preferable for reducing problems such as insufficient reaction and segregation, which have been encountered with the case of TiCN, $Si_3N_4$ or the like. In general, super fine particles, each having a particle size of 0.1 $\mu$m or less is preferable. In this case, it is necessary to consider the removal of gas adsorbed in such fine powders. The sintering temperature can range from 1300 to 1650° C. and, more preferably, from 1350 to 1600° C. And the sintering pressure can range from 0.1 to 3000 MPa and, more preferably, from 0.1 to 2000 MPa.

Hereinafter the operational advantages of the present invention will be explained.

With the present invention, by preparing a mixed powder containing powders of TiCN, $Si_3N_4$, $Al_2O_3$, CrxN (x=1–2.7), ZrN, and W (W only, WC only, or both W and WC), each having the above-described specific composition ratio, and powders of at least one kind of metal powder selected from the group consisting of Co, Ni, Ta and Mo, and sintering the prepared mixed powder , sintered cermet materials are obtained. The sintered cermet materials which are formed by sintering the mixed powder composed of these starting raw materials are excellent in heat resistance, and accordingly, where used in an environment in which the temperature is high, as tips of cutting tools, or the like, the hardness and strength thereof can be ensured, the durability is improved, and the tool life can be extended. Accordingly, where the sintered cermet materials of the present invention are used as tools such as cutting tools, excellent durability and fracture resistance can be achieved.

Conventionally, where work pieces which are difficult to be cut, such as niresist cast iron and austempered spheroidal graphite cast iron which are called high class cast iron, are cut, even the sintered materials of TiC, TiN or TiCN with $Al_2O_3$, have not been able to achieve sufficient durability. It is considered that this problem is caused by the heat resistance, oxidation resistance and durability of the starting raw materials themselves being low. In contrast, with the present invention, by using the mixed powder which contains TiCN, $Si_3N_4$, $Al_2O_3$, CrxN (x=1–2.7), ZrN or the like in a specific composition ratio, as a starting raw material, in the obtained sintered cermet materials, there are formed new crystal phases of which the crystal structure is changed relative to that of TiCN, $Si_3N_4$, $Al_2O_3$, CrxN (x=1–2.7), ZrN. Accordingly, the obtained sintered cermet materials have very high hardness and excellent oxidation resistance, and these crystal phases are bonded strongly. For these reasons, it can be estimated that the obtained sintered cermet materials are excellent in heat resistance and durability.

Therefore, the sintered cermet material of the present invention exhibits excellent heat resistance, oxidation resistance or durability, and accordingly is effectively applied to cutting tools, for example. Where the sintered cermet material of the present invention is used as the cutting tools for cutting high class cast iron such as niresist cast iron and austempered spheroidal graphite cast, vigorous shock and heat are generated in tips of tools. Since the sintered cermet material of the present invention has improved heat resistance and oxidation resistance, the wear resistance (durability) is ensured without decreasing the hardness due to heat. In addition, since in the sintered cermet materials of the present invention, newly formed crystal phases ere bonded strongly, the toughness is high, and fracture of cutting tools can be restrained upon a heavy cutting and interrupted cutting, and accordingly cutting tools which are excellent in fracture resistance and wear resistance can be obtained.

In addition, with the present invention, it is preferable that 5 to 20 vol. % of SiC is added with external addition to the mixed powder having the above-described composition according to the quality of the material of the work pieces or the like. The method of adding 20 vol. % of SiC with external addition means the method that where the volume of the mixes powder is 100, 20 of SiC is added to 100 of the mixed powder to obtain 120 in total By adding SiC, the wear resistance of tools such as cutting tools is much improved. Examples of the upper limit of the external addition of SiC include 18%, 16% and 14%, and examples of the lower limit of the external addition of SiC include 6%, 8% and 10%.

SiC has two types of the crystal structure, namely alpha-type of the rhombohedral wurizite type, and β type of the cubic system zinc-blende type. Any type of SiC will do, but more elastic alpha-type is preferable. By adding SiC, the hardness of the sintered materials is enhanced, and accordingly the wear resistance of the obtained sintered cermet materials is much improved. Where the amount of SiC is less than 5 vol. %,the hardness is scarcely improved, and where the amount of SiC exceeds 20 vol. %, the balance in the above-described composition is difficult to be kept. In particular, the toughness of the matrix of the sintered cermet materials decreases, and accordingly, occurrence of fractures inversely increases. In consideration of these problems, the preferred amount of SiC to be added with external addition is determined to range from 7 to 15 vol. %. It is preferable that the particle size of SiC powder is smaller than that of the mixed powder . Where SiC powder must be pulverized to disperse SiC as a reinforcement in a matrix homogeneously, although attention should be paid to pollution by impurities, it is preferable that the particle size of SiC powder is 3 $\mu$m or less and, more preferably 2 $\mu$m to 1 $\mu$m or less. In general, it is favorable that SiC powder is super fine particles, each having a particle size of 0.1 $\mu$m or less. In this case, it is preferable to consider the removal of gas adsorbed in such fine powders. Where the wear resistance or other properties of the sintered cermet material is sufficiently obtained without adding SiC, SiC may not be added.

The heating conditions upon sintering can be 1300–1650° C. preferably 1400–1550° C. The pressure upon sintering can be 0.1–3000 Mpa, preferably 0.1–2000 MPa.

Other objects, features, and characteristics of the present invention will become apparent upon consideration of the following description and the appended claims with reference to the accompanying drawings, all of which form a part of this specification.

DETAILED DESCRIPTION OF THE PRESENTLY PREFERRED EXEMPLARY EMBODIMENTS

Figure 1:
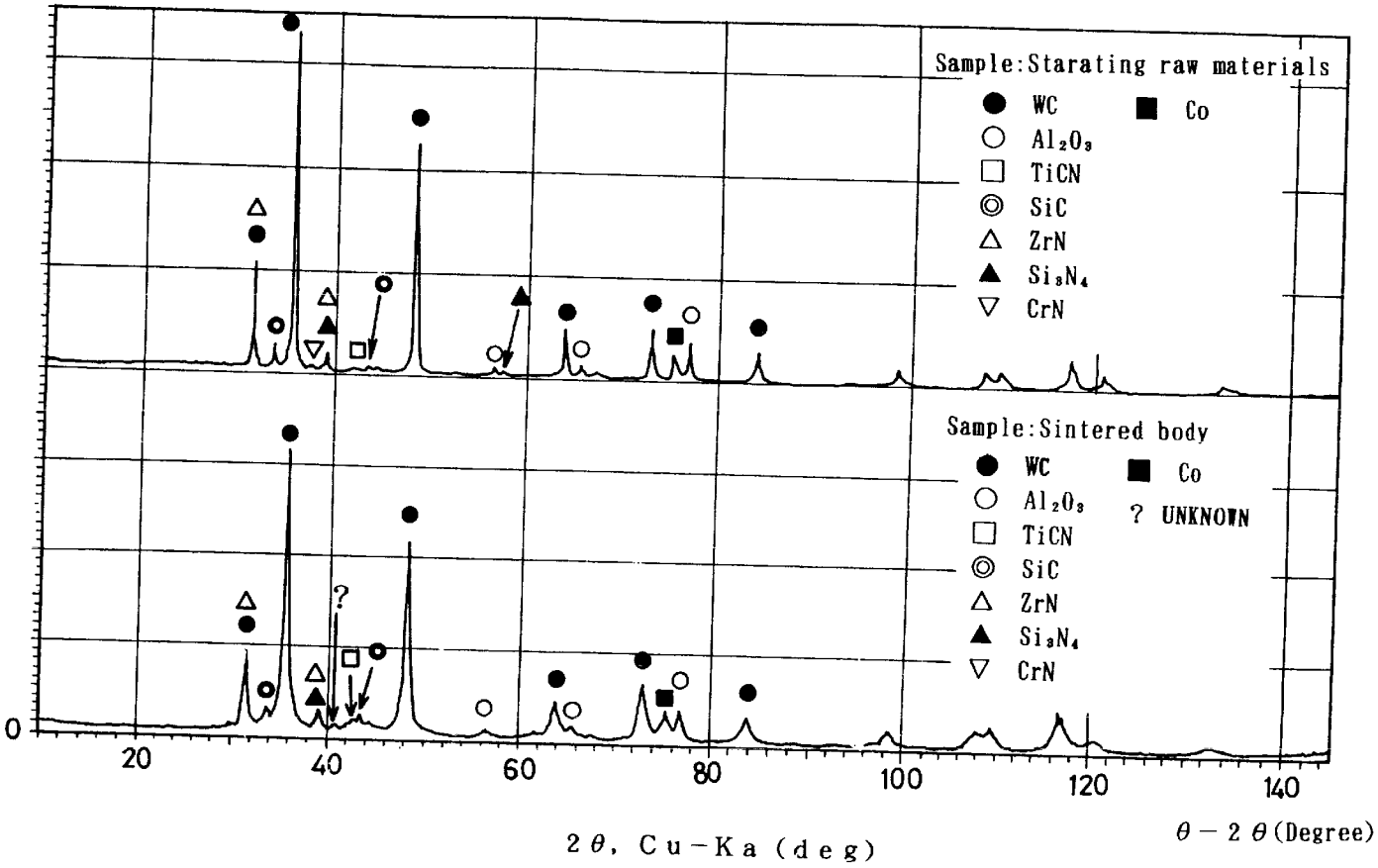
FIG. 1 illustrates an X-ray diffraction diagram showing the state of each of a starting raw material and a resulting sintered material.

Hereinafter, embodiments of the present invention will be explained.

As starting raw materials, $Si_3N_4$ powder (silicon nitride) having an average particle size of 2.0 $\mu$m, TiCN powder (carbon titanium nitride ) having an average particle size of 2.0 $\mu$m or less, $Al_2O_3$ (alumina) having an average particle size of 1.0 $\mu$m or less, CrxN (chromium nitride) having an average particle size of 2.0 $\mu$m or less, ZrN (zirconium nitride) having an average particle size of 2.0 $\mu$m or less and SiC (silicon nitride) having as average particle size of 2.0 $\mu$m or less were used. In addition, tungsten powder having an average particle size of 2.0 $\mu$m or less and metal powder having an average particle size of 2.0 $\mu$m or less were used. In the later described No. 6, a mixture of W powder (tungsten) and WC powder (tungsten carbide) were used as the tungsten powder, and in Nos. 1 to 9, and comparative examples 1 to 3, WC powder was used as the tungsten powder.

As the metal powder, as shown in ( ) of the column M*4 of Table 1, one kind of metal selected from the group consisting of Ni powder, Co powder, Ta powder and Mo powder was used. For restraining the formation of intermetallic compounds, only one kind of metal was used.

These powders were combined in the composition ratios shown in TABLE 1, and mixed together with a planetary ball mill for 1 hour to obtain mixed powder s. Then, the mixed powder s were dried and compression-molded with a mold to form molded bodies. As shown in the column "pressure" of TABLE 1, the resultant molded bodies were held in a pressurized state by a hot pressing or hot isostatic pressing (HIP), or with a piston•cylinder device, and then sintered. The pressing conditions upon sintering were as follows: pressure: 0.1 Mpa–2000 MPa, temperature: 1400 to 1550° C. and holding time: 0.5 to 6 hours. The concrete conditions of each test pieces are shown in TABLE 1. If the sintering is carried out under a high pressure, the production costs increase.

Therefore, where good wear resistance is obtained by adjusting the composition ratio of the mixed powder, the pressure while sintering is determined so as not to increase highly.

After sintered, the temperature was decreased, and the pressure is lowered to obtain materials for cutting tools as test pieces No. 1 to No. 9 which correspond to embodiments of the present invention. These materials (No. 1 to No. 9) do not contain expensive cBN.

In the column "pressure" in TABLE 1, "*1" means that the hot pressing was carried out, while flowing argon gas, "*2" means that the hot isostatic pressing (HIP) was carried out; and *3 means the piston•cylinder method of pressing work pieces inserted into cylinders with pistons.

TABLE 1 (a)

| Embodiment | Composition ratio (vol %) | | | | | | | Vol % | Sintering condition | | | Result of cutting test |
|---|---|---|---|---|---|---|---|---|---|---|---|---|
| | | | | | | | | SiC External | Pressure | Temperature | Time | Wear Amount |
| No. | TiCN | $Si_3N_4$ | $Al_2O_3$ | $Cr_xN$ | ZrN | WC, W + WC | M *4 | addition | (MPa) | (° C.) | (hrs) | $V_B$ (mm) |
| 1 | 7 | 10 | 15 | 8 | 5 | 35 | 20 (Mo) | 7 | 0.05 | 1550 | 2.5 | 0.192 |
| 2 | 10 | 7 | 18 | 10 | 5 | 40 | 10 (Mo) | 0 | 0.10 | 1500 | 3 | 0.211 |
| 3 | 10 | 8 | 10 | 7 | 10 | 45 | 10 (Ta) | 5 | 150 *2 | 1500 | 4 | 0.178 |
| 4 | 15 | 5 | 17 | 8 | 8 | 42 | 5 (Ni) | 5 | 10 *1 | 1500 | 3.5 | 0.175 |
| 5 | 13 | 5 | 13 | 8 | 12 | 41 | 8 (Co) | 7 | 10 *1 | 1500 | 4.0 | 0.168 |
| 6 | 20 | 10 | 20 | 5 | 10 | 30 | 5 (Co) | 20 | 0.1 | 1500 | 1.5 | 0.184 |
| 7 | 15 | 7 | 19 | 10 | 4 | 30 | 15 (Co) | 7 | 0.05 | 1550 | 2 | 0.201 |
| 8 | 8 | 7 | 8 | 10 | 14 | 50 | 3 (Ni) | 10 | 0.1 | 1450 | 4 | 0.189 |

TABLE 1 (a)-continued

| Embodiment No. | Composition ratio (vol %) TiCN | $Si_3N_4$ | $Al_2O_3$ | $Cr_xN$ | ZrN | WC, W + WC | M *4 | Vol % SiC External addition | Sintering condition Pressure (MPa) | Temperature (° C.) | Time (hrs) | Result of cutting test Wear Amount $V_B$ (mm) |
|---|---|---|---|---|---|---|---|---|---|---|---|---|
| 9 | 13 | 5 | 13 | 12 | 8 | 34 | 15 (Ta) | 7 | 2000 *3 | 1400 | 0.5 | 0.160 |

Sintering method:
*1: hot pressing (Ar flow)
*2: hot isostatic pressing (HIP)
*3: piston · cylinder
*4: metal ( ) contained
both W and WC added in No. 6, only WC added in other embodiments and examples TABLE 1 (b)

| No. | Composition ratio (vol %) TiCN | $Si_3N_4$ | $Al_2O_3$ | $Cr_xN$ | ZrN | WC, W + WC | M *4 | Vol % SiC External addition | Sintering condition Pressure (MPa) | Temperature (° C.) | Time (hrs) | Result of cutting test Wear Amount $V_B$ (mm) |
|---|---|---|---|---|---|---|---|---|---|---|---|---|
| Comparative Example 1 | 30 | 0 | 30 | 5 | 5 | 20 | 10 (Mo) | 7 | 0.05 | 1550 | 1 | 0.244 |
| Comparative Example 2 | 40 | 1 | 30 | 0 | 15 | 12 | 2 (Co) | 2 | 30 *1 | 1800 | 2 | fracture |
| Comparative Example 3 | 5 | 5 | 5 | 15 | 30 | 40 | 0 (—) | 0 | 0.1 | 145m0 | 3 | 0.230 |
| Conventional Example 1 | cermet tool on the market TiN—TiC—WC—Co | | | | | | | | — | — | — | 0.542 |
| Conventional Example 2 | cermet tool on the market TiCN—WC—Co—VC—MoC | | | | | | | | — | — | — | 0.382 |
| Conventional Example 3 | cBN tool on the market cBN 80 vol %/(WC—Co) 20 vol % | | | | | | | | — | — | — | fracture |
| Conventional Example 4 | cBN tool on the market cBN 60 vol %/($Al_2O_2$—TiC) 40 vol % | | | | | | | | — | — | — | fracture |

Sintering method:
*1: hot pressing (Ar flow)
*2: hot isostatic pressing (HIP)
*3: piston · cylinder
*4: metal ( ) contained
both W and WC added in No. 6, only WC added in other embodiments and examples Peaks of the X-ray diffraction of the typical material for cutting tools (No. 5), which is one of the test pieces obtained by the above-described method, are shown in FIG. 1. And, for comparison, peaks of the X-ray diffraction of the mixed powder before sintered are also shown. In FIG. 1, ● indicates WC. ○ indicates $Al_2O_3$, □ indicates TiCN, ⓞ indicates SiC, Δ indicates ZrN, ▲ indicates $Si_3N_4$, ▽ indicates CrN, ■ indicated Co, and ? indicates unknown material.

As is apparent from the result of X-ray diffraction, which is shown in FIG. 1, it was confirmed that in the sintered cermet material after sintered, in accordance with the present invention, there was formed a new material (which is a peak indicated by the symbol ? in FIG. 1), of which the crystal structure is changed relative to that of TiCN, $Si_3N_4$, $Al_2O_3$, CrxN (x=1–2,7), ZrN and SiC as the starting raw materials. This new material is now unknown.

Figure 2:
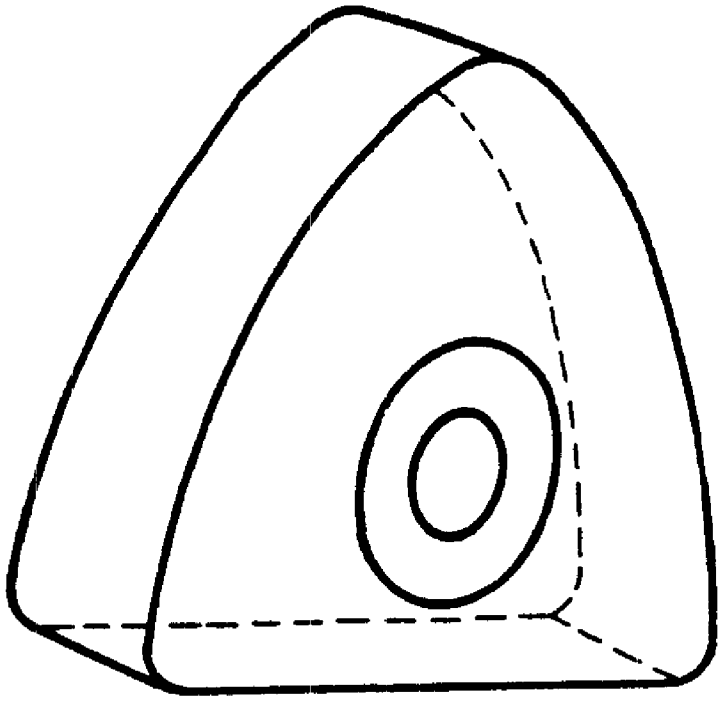
FIG. 2 illustrates a perspective view illustrating a representative configuration of a cutting tool to which the present invention is applied.

The materials for cutting tools, which had been respectively formed with the above-described method, were respectively shaped to obtain cutting tools, each having a prescribed configuration (JIS ; SPGN 120304SN). As shown in FIG. 2, the cutting tool has a triangular configuration having rounded comers. This cutting tool is entirely composed of sintered cermet material in accordance with the present invention. Work pieces were cut using obtained cutting tools under the following cutting conditions.

Cutting conditions work piece: niresist cast iron having an external diameter of ϕ 110 mm (JIS: FCA-NiCuCrl562 hardness:Hvl63)

cutting speed: 230 m/min feed rate: 0.3 mm/rev depth of cut: 2.0 mm cutting coolant: chemicool SR-1

Then, the flank wear (vB) of each cutting tool in case that the length of cut is 5 km was measured. The measured results were evaluated as the tool life of the cutting tools in the cutting test The results of these cutting tests are also shown in TABLE 1.

Furthermore, as a comparative example 1, a sintered cermet material was prepared using a starting raw material which had the composition ratio indicated in TABLE 1 with $Si_3N_4$, excluded. As a comparative example 2, a sintered cermet material was prepared using a starting raw material which had the composition ratio indicated in TABLE 1 with CrxN excluded. As a comparative example 3, a sintered cermet material was prepared using a starting raw material which had the composition ratio indicated in TABLE 1 with metal components excluded Comparative examples 1, 2 and 3 were subjected to the cutting tests, similarly.

In addition, as a conventional example 1, the cutting tool on the market, which was composed of a conventional TrN-TiC-WC-Co sintered cermet material, was subjected to the cutting test, similarly. As a conventional example 2, the cutting tool on the market which was composed of a conventional TiCN-WC-Co-VC-MoC sintered cermet material, was subjected to the cutting test, similarly. As conventional examples 3 and 4, cutting tools on the market which were composed of a conventional cBN sintered material, were subjected to the cutting tests, similarly. Conventional example 3 is a cutting tool composed of a sintered material which was obtained by sintering a mixture material in which 80 vol. % of cBN and 20 vol. % of (WC-Co) were mixed. Conventional example 4 is a cutting tool composed of a sintered material which was obtained by sintering a mixture material in which 60 vol. % of cBN and 40 vol. % of ($Al_2O_3$-TiC) were mixed. The performance of each of these conventional examples is also shown in TABLE 1.

As is apparent from TABLE 1, in No. 1 to No. 9 which correspond to embodiments of the present invention, the wear amount of each cutting tool was small, there was not observed any fracture therein, and the wear resistance and fracture resistance thereof were good. Thus, the results of the cutting tests were good. In particular, where the starting raw materials contain SiC, the wear amounts of the resultant cutting tools were small, there was not observed any fracture therein, and the wear resistance and fracture resistance thereof were good Thus, the results of the cutting test were good.

In addition, as is apparent from TABLE 1, in No. 1 to No. 9 which correspond to embodiments of the present invention, the wear amount of the resultant cutting tools decreased as the pressure upon sintering increased.

In comparative examples 1 to 3, the results of the cutting tests thereof were not good In particular, in the comparative example 2 which does not contain CrN, the fracture occurred in the cutting tool, although the pressure upon sintering was as large as 30 MPa. In the conventional examples 1 to 4, the results of the cutting tests thereof were not good These results are estimated to be caused by CrN being not contained.

$Si_3N_4$, and SiC may be added in the form of whisker instead of the form of fine particulates. In the cutting tools of the embodiments, niresit cast iron was adopted as the material of work pieces; and niresit cast iron was cut. The present invention can be also applied to the work pieces composed of other materials such as austempered spheroidal graphite cast iron, normal cast iron including spheroidal graphite cast iron and flake graphite cast iron, carbon steel and alloy steel.

The above-described embodiments are preferably used as the cutting tools for high speed cutting which is performed at a high cutting speed, and heavy cutting which is performed with a large cutting amount per cutting work. Lt addition, they are also applicable to other cutting methods than the high speed cutting and heavy cutting. For example, they are applicable to the cutting methods wherein the cutting speed or cutting amount are normal.

In the above-described embodiments, the present invention was applied to the cutting tools. The present invention is also applicable to reference metals, anvils, die punches, excavation bits or the like. Instead of the compositions of the embodiments, two, three or four kinds of metals selected from the group consisting of Co, Ni, Ta and Mo can be also combined, The upper limit and lower limit of each of powders of TiCN, $Si_3N_4$, $Al_2O_3$, CrxN and ZrN, at least one powder of W and WC, and at least one metal powder selected from the group consisting of Co, Ni, Ta and Mo may be limited to those indicated in TABLE 1, if required. In addition, the present invention is not limited to the embodiments disclosed before and shown in the drawings, and can be modified without departing from the spirit and scope of the present invention.

From the above disclosure, the following technical idea can be also obtained Non-cBN sintered cermet materials containing no cBN, each being composed of a sintered body which is obtained by preparing a mixed powder containing powders of TiCN, $Si_3N_4$, $Al_2O_3$, CrxN (x=1–2.7) and ZrN, at (east one powder of W and WC, and at least one metal powder selected from the group consisting of Co, Ni, Ta and Mo, and sintering the prepared mixed powder , and a method for producing such non-cBN sintered cermet materials.

In accordance with the present invention, the heat resistance of the sintered cermet material is enhanced, and accordingly, when used at elevated temperatures the hardness and strength can be ensured. Consequently, in the environments where there occurs contacting with other members, such as upon cutting, good wear resistance and good fracture resistance can be ensured, and accordingly it is favorable for improving the durability and extending life time of the materials: For these reasons, where the present invention is applied to cutting tools, work pieces composed of high class cast iron such as niresist cast iron and austempered spheroidal graphite cast iron, which are difficult to be cut, can be favorably subjected to the high spied cutting and the heavy cutting. In addition, where such high speed cutting and heavy cutting are applied to the work pieces composed of such high class cast iron, long tool life of cutting tools can be effected.

What is claimed is:

1. A sintered cermet material for tools comprising a sintered body which is obtained by preparing a powder mixture comprising powders of TiCN, $Si_3N_4$, $Al_2O_3$, CrxN (x=1–2,7) and ZrN, either or both of W and WC, and at least one metal selected from the group consisting of Co, Ni, Ta and Mo; and then sintering said powder mixture.

2. The sintered cermet material as claimed in claim 1, wherein said mixed powder comprises 1 to 20 vol. % of TiCN, relative to the volume of overall powders combined, 1 to 10 vol. % of $Si_3N_4$, 1 to 20 vol. % of $Al_2O_3$, 5 to 15 vol % of CrxN (x=1–3 2,7) and 5 to 15 vol. % of ZrN such that the combined volume of powders of TiCN, $Si_3N_4$, $Al_2O_3$, CrxN and ZrN is between 13 to 70 vol. %, said mixed powder further comprising 20 to 70 vol. % of either one or both of W and WC combined, and 1 to 20 vol. % of at least one metal powder selected from the group consisting of Co, Ni, Ta and Mo.

3. The sintered cermet material as claimed in claim 1, wherein said mixed powder comprises 5 to 20 vol. % of SiC with external addition.

4. The sintered cermet material as claimed in claim 1, wherein the ratio in number of atoms of N and C in TiCN is between (1:9) and (9:1).

5. The sintered cermet material as claimed in claim 1, wherein said mixed powder comprises 5 to 20 vol. % of TiCN.

6. The sintered cermet materiel as claimed in claim 1, wherein said TiCN powder has a particle size of 5 $\mu$m or less.

7. A sintered cermet material as claimed in claim 1, wherein where the total of said mixed powder is 100 vol. %, said mixed powder comprises 5 to 10 vol. % of $Si_3N_4$.

8. The sintered cermet material as claimed in claim 1, wherein said $Si_3N_4$ powder has a particle size of 5 $\mu$m or less.

9. The sintered cermet material as claimed in claim 1, wherein said mixed powder comprises 5 to 20 vol. % of $Al_2O_3$.

10. The sintered cermet material as claimed in claim 1, wherein said $Al_2O_3$ powder has a particle size of 5 $\mu$m or less.

11. The sintered cermet material as claimed in claim 1, wherein said mixed powder comprises 8 to 13 vol. % of CrxN (x=1–2.7).

12. The sintered cermet material as claimed in claim 1, wherein said CrxN (x=1–2.7) powder has a particle size of 5 $\mu$m or less.

13. The sintered cermet material as claimed in claim 1, wherein said mixed powder comprises 8 to 13 vol. % of ZrN.

14. A sintered cermet material as claimed in claim 1, wherein said ZrN powder has a particle size of 5 $\mu$m or less.

15. The sintered cermet material as claimed in claim 1, wherein said mixed powder comprises 30 to 60 vol. % of powder of either or both of W and WC.

16. The sintered cermet material as claimed in claim 1, wherein said W and WC powders have a particle size of 1 $\mu$m or less.

17. The sintered cermet material as claimed in claim 1, wherein said mixed powder comprises 5 to 15 vol. % of at least one selected from the group consisting of Co, Ni, Ta and Mo.

18. The sintered cermet material as claimed in claim 1, wherein said sintered cermet material is used in either cutting tools, reference metals, anvils, die punches or excavation bits.

19. A method for producing a sintered cermet material comprising the steps of:

preparing a mixed powder containing powders of TiCN, $Si_3N_4$, $Al_2O_3$, CrxN (x=1–2.7) and ZrN, either or both of W and WC, and at least one metal selected from the group consisting of Co, Ni, Ta and Mo; and sintering said prepared mixed powder to produce a sintered body.

20. The method as claimed in claim 19, wherein said mixed powder comprises 1 to 20 vol. % of TiCN, 1to 10 vol. % of $Si_3N_4$, 1 to 20 vol. % of $Al_2O_3$, 5 to 15 vol. % of CrxN (x=1–2.7) and 5to 15 vol. % of ZrN such that the combined volume of powders of TiCN, $Si_3N_4$, $Al_2O_3$, CrxN and ZrN is between 13 and 70 vol. %, said mixed powder further comprises 20 to 70 vol. % of either or both of W and WC combined, and 1 to 20 vol. % of at least one kind of metal selected from the group consisting of Co; Ni, Ta and Mo.

21. The method as claimed in claim 19, wherein said mixed powder contains 5 to 20 vol. % of SiC with external addition.

22. The method as claimed in claim 21, wherein said SiC has a particle size of 3 $\mu$m or less.

23. The method as claimed in claim 19, wherein said step of sintering is conducted at a temperature of 1300° to 1650° C.

24. The method as claimed in claim 19, wherein said step of sintering is conducted at a pressure of 0.1 MPa to 2000 MPa and a temperature of 1300° to 1650° C.

25. The method as claimed in claim 19, wherein said step of sintering is conducted at a pressure of 0.1 MPa to 3000 MPa at a temperature of 1400° to 1550° C. for 0.5 to 6 hours.

* * * * *